US005311955A

United States Patent [19]

Ganijew et al.

[11] Patent Number: 5,311,955

[45] Date of Patent: May 17, 1994

[54] INSTALLATION FOR CLEANING THE ZONE NEAR THE DRILL HOLE

[75] Inventors: Rifner W. Ganijew, Moskau; Robert S. Mufasalow, Bassr; Remus C. Wasiliew, Moskau; Jurij P. Sacharow, Moskau; Raschid G. Muchutdinow, Moskau, all of U.S.S.R.

[73] Assignee: Wave Tec Ges.m.b.H., Laxenburg, Austria

[21] Appl. No.: 878,476

[22] Filed: May 5, 1992

[30] Foreign Application Priority Data

May 6, 1991 [SU] U.S.S.R. ..... 4928469

[51] Int. Cl.[5] ..... E21B 7/18

[52] U.S. Cl. ..... 175/67; 175/393

[58] Field of Search ..... 175/339, 340, 393, 67

[56] References Cited

U.S. PATENT DOCUMENTS 4,389,071 6/1983 Johnson, Jr. et al. ..... 175/67 X
4,391,339 7/1983 Johnson, Jr. et al. ..... 175/393
4,474,251 10/1984 Johnson, Jr. ..... 175/67
4,744,420 5/1988 Patterson et al. ..... 175/67 X
5,086,974 2/1992 Henshaw ..... 175/67 X
5,199,512 4/1993 Curlett ..... 175/67

FOREIGN PATENT DOCUMENTS 9114076 9/1991 PCT Int'l Appl. .
2224054 4/1990 United Kingdom .

*Primary Examiner*—William P. Neuder
*Attorney, Agent, or Firm*—Rothwell, Figg, Ernest & Kruz

[57] ABSTRACT

The installation for cleaning the zone near the drill hole contains a hollow body (1) in which is arranged a subassembly for generating hydrodynamic waves that is designed in the form of a turbulence chamber (3) that has, arranged tangentially in its upper part, entry channels (4) with which the subassembly is connected to the cavity of the body (1). The outlet channel (5) of the turbulence chamber (3) is designed with a conical taper.

7 Claims, 4 Drawing Sheets

INSTALLATION FOR CLEANING THE ZONE NEAR THE DRILL HOLE

TECHNICAL FIELD

Figure 1:
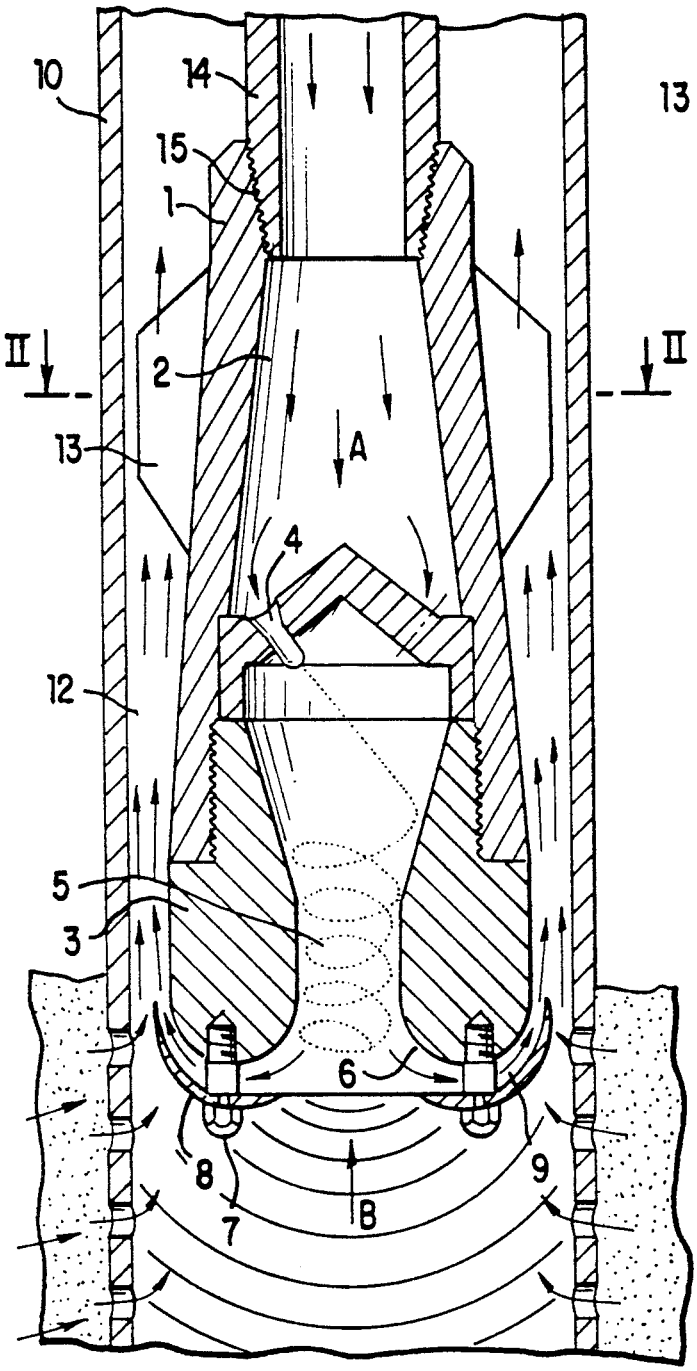

The present invention refers to installations for processing and cleaning the zone near the drill hole in a subterranean drilling installation using hydrodynamic waves and, in particular, to installations for cleaning the zone near the drill hole.

BACKGROUND OF THE INVENTION

There is a known installation for cleaning the zone near the drill hole (S.M. Godiev "Inspolzovanie vibratsii v. dobyche nefti" (Utilization of vibrations in petroleum conveying), 1977, "Nedra" editions (Moscow), p. 50, FIG. 27) that contains a hollow body with a subassembly arranged in it for generating hydrodynamic waves. This subassembly constitutes a case housed in the body at minimal distances from its walls. The case is arranged rotatable around its axis in rolling bearings. There are openings on the walls of the body and the case that serve as channels for the liquid to pass through. The body has radial outlet channels and the case has tangential outlet channels. To prevent leakage of the liquid through the annular gap, a sleeve seal is arranged in the upper part between the body and the case. The outlet channels of the case and the body are on the same level.

The installation with ascending pipes is lowered into a drill hole until reaching the level of the arrangement of perforation openings. A working fluid is pressed in through the ascending pipes. By coming into the cavity of the case, the liquid also flows into the tangentially arranged outlet channels of the case. The liquid flows out of the outlet channels into the radial channels of the body and from there into the torus of the drill hole.

If the liquid flows out through the tangential channels of the case at a high velocity, a reaction torque is created at the case, whereby it is made to rotate around the body. In this process, the channels of the case and the body are periodically closed and opened with a certain frequency. Hydrodynamic liquid pulsations are created by the periodic covering of the channels in the zone near the drill hole. The amplitude and frequency of the hydrodynamic pulsations depend on the pressure of the liquid being flushed and the frequency of rotation of the case around the body.

Due to their insufficient strength, the hydrodynamic pulsations created do not contribute to the destruction of various deposits on the drill hole walls and do not provide for cleaning of the clogged pore channels of a petroleum-yielding seam.

Furthermore, the known installation has a complicated construction, which increases its production costs and reduces its operating reliability, while the presence of the moving subassemblies and parts in the construction leads to its intensive mechanical wear and reduces the service life of the installation.

All of this means that the known installations do not ensure an effective cleaning of the zone near the drill hole and do not promote an increase in productivity of a drill hole or in petroleum yield of a seam.

DISCLOSURE OF THE INVENTION

The invention is based on the task of designing the hydrodynamic wave generating subassembly of the installation for cleaning the zone near the drill hole in such a way that by generating and utilizing the high level of wave energy with directed effect from the hydrodynamic waves with a broad frequency spectrum in the drill hole vicinity that are created by a turbulent current of the liquid, and by creating a partial vacuum in this vicinity, an increase in the productivity of a drill hole and in the petroleum yield of a seam is guaranteed.

The thus presented task is solved according to the invention in the following way. In the installation for cleaning the zone near the drill hole, which contains a hollow body with a subassembly arranged inside it for generating hydrodynamic waves, the subassembly for generating hydrodynamic waves is designed in the form of a turbulence chamber that is connected to the cavity of the body by entry channels arranged tangentially in its upper part and has a conically tapering outlet channel.

The subassembly for generating hydrodynamic waves, designed in the form of a turbulence chamber with tangentially arranged entry channels, makes it possible to generate hydroacoustic waves with a broad frequency spectrum to act on a productive seam. In addition, the use of the turbulence chamber makes it possible to create a partial vacuum, i.e., a depression, in the zone near the drill hole. All of this considerably improves cleaning of the pore channels and increases the petroleum flow to the drill hole.

The narrowing of the outlet channel of the turbulence chamber is based on the fact that as the channel diameter decreases, the rotating frequency of the liquid increases proportionally to the turbulence chamber diameter-outlet pipe diameter ratio, and the frequency of wave emission accordingly increases.

It is useful to equip the subassembly for generating hydrodynamic waves with at least one additional turbulence chamber that is arranged in the body over the main turbulence chamber and is connected to the cavity of the body by tangentially arranged entry channels, and to provide the subassembly with two conically tapering outlet channels directed in opposition directions and arranged axially.

This makes it possible to increase the zone of action on a petroleum-yielding seam and to intensify the process of cleaning the zone near the drill hole.

It is useful to have, in the wall of the turbulence chamber on the section of the arrangement of its outlet channel, a toroidal cavity connected to the inside of the turbulence chamber.

The toroidal resonance space designed in the wall of the turbulence chamber serves to increase the amplitude of the waves generated under the resonance conditions. In addition, waves that are generated by a sharp edge of the entry channel of the toroidal cavity also contribute to increasing amplitude. When the radial-tangential current hits the sharp edge at the entrance of the resonance chamber at high velocity, self-oscillations of low amplitude are stirred up that create cutting tone waves the frequency of which is itself contingent on the outflow velocity, the density of the injected liquid and the rigidity of the resonator wall.

It is advantageous to have the subassembly for generating hydrodynamic waves equipped with a guide blade arranged in the lower part of the turbulence chamber in such a way that an annular channel is formed between the outer frontal surface of the turbulence chamber and the inside surface of the guide blade turned toward it, which are both shaped rounded off.

The guide blade arranged in the vicinity of the frontal surface of the turbulence chamber wall forms an annular channel—nozzle—and forms an annular current from the radial-tangential current flowing out of the outlet channel. The guide blade directs this annular current upward through the torus. This contributes to improving the quality of the vacuum and the depression effect on the zone near the drill hole.

Designing the frontal surface of the wall of the turbulence chamber with a radial rounding off makes it possible to keep hydrodynamic losses lower during steering and forming of the upwardly directed current.

To create the core of a vacuum in the turbulence chamber and increase the oscillation amplitude of the liquid pressure, it is necessary for the tangentially arranged entry channels of the additional turbulence chamber to be designed at an angle to its axis and directed toward opposite sides.

It is useful to have the cavity of the turbulence chamber designed in a spherical shape.

The choice of a spherical shape for the turbulence chamber is due to the high amplitude of the waves generated by spherical radiators working in self-oscillation operation with a periodical hydraulic self-blocking of the outlet channel.

It is preferable for the turbulence chamber to be equipped with a conical wave guide attached in its upper part in the direction of its longitudinal axis, with the conical taper of its lateral surface determined by the relation $$\theta < \alpha \leqq 2\theta'$$

where $\alpha$ is the conical taper of the lateral surface of the wave guide;

$\theta'$ is the critical angle of approach of a wave generated in the turbulence chamber and coming in to the wave guide.

The purpose of equipping the turbulence chamber with the conical wave guide is to prevent hydrodynamic and hydroacoustic cavitation wear on the central part of the head of the turbulence chamber. In addition, the conical wave guide brings the cavitation bubbles out of the turbulence chamber.

The cone taper $\alpha$ of the conical wave guide is chosen equal to or less than twice the value of the critical angle of approach $\theta'$ of an incident wave, i.e., $\theta < \alpha \leqq 2\theta'$, because the boundary surface of the two media (injected liquid and metal) with different density and compressibility levels constitutes a reflective, absorptive, breaking surface. If the angle of approach $\theta$ of the incident wave is not greater than the critical angle of approach $\theta'$, then a total reflection takes place. Such a wave does not transfer any energy from the first medium (from the liquid) to the second medium (to the metal), and the total energy of the incident wave is reflected by the surface of the wave guide back to the first medium. An angle between the propagation angle of the wave and the boundary surface is designated as angle of approach. The cosine of the critical angle of approach $\theta'$ is equal to the refractive index of the second medium with respect to the first medium (Snell's law), i.e.:

$$\cos\theta' = c/c_1 = n$$

where c is the acoustic velocity in the injected liquid;

$c_1$ is the acoustic velocity in the metal;

n is the refractive index.

The conical taper $\alpha$ of the wave guide must not be above $2\theta'$, i.e. $\theta < \alpha \leqq 2\theta'$ It also makes sense for the subassembly for generating hydrodynamic waves to be equipped with a resonance chamber the cavity of which is connected to the cavity of the turbulence chamber and which houses a piston with a rod with the ability to shift in longitudinal direction.

This makes it possible to tune the generated waves to a resonance frequency for various flow quantities and densities of the injected liquid. Tuning to the resonance frequency is done by shifting the piston by means of a worm rod and by changing the volume of the resonance chamber under the piston.

When equipped with the turbulence chamber according to the invention, the installation for cleaning the zone near the drill hole thus makes it possible to execute a complex drill hole treatment in connection with thermal-physical-chemical procedures and to increase the productivity and petroleum yield of a seam. The installation has a simple construction, is reliable and is suitable for production.

BRIEF LIST OF THE DRAWINGS

Figure 2:
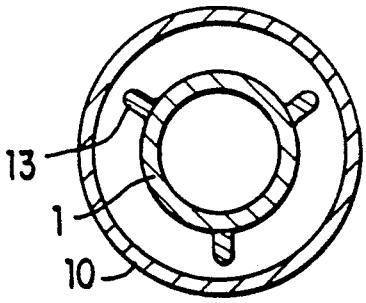
Figure 3:
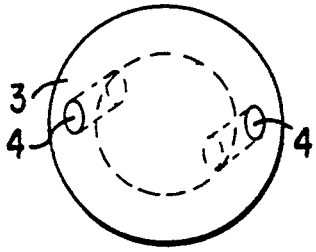
Figure 4:
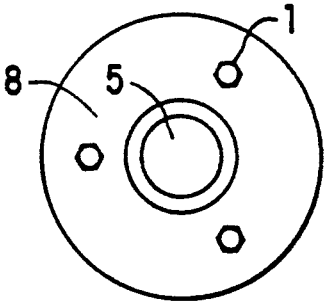
Figure 5:
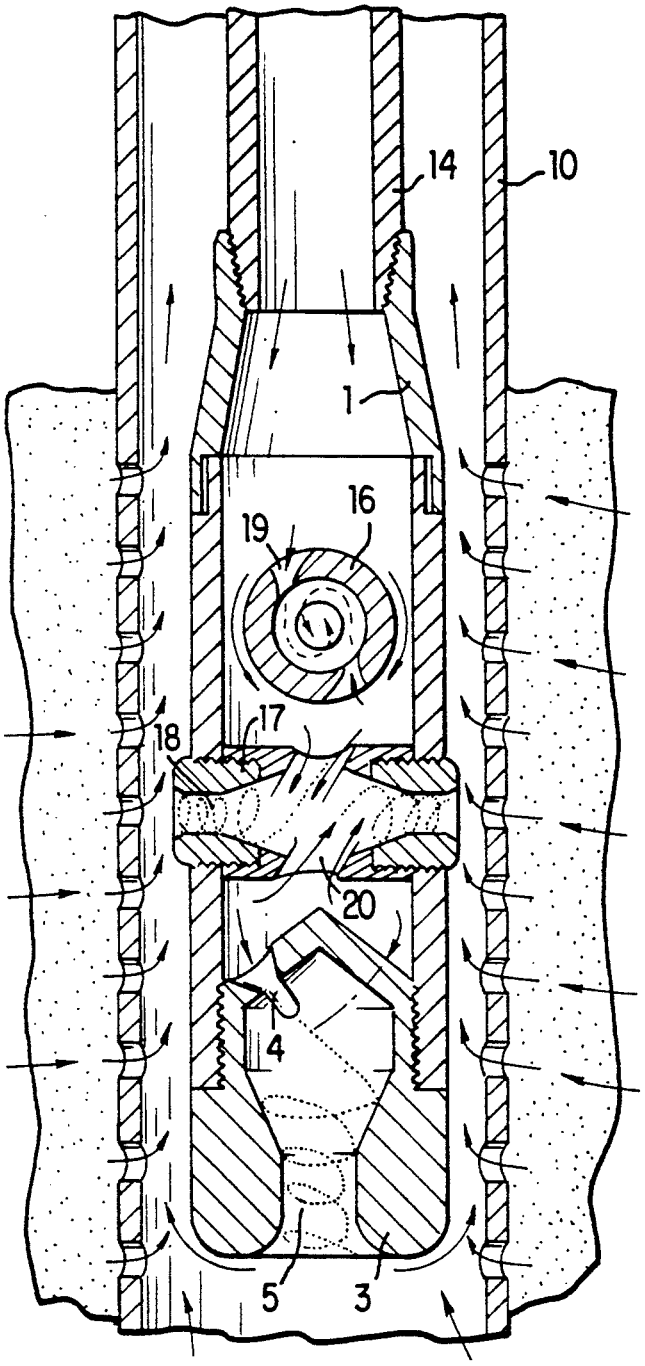
Figure 6:
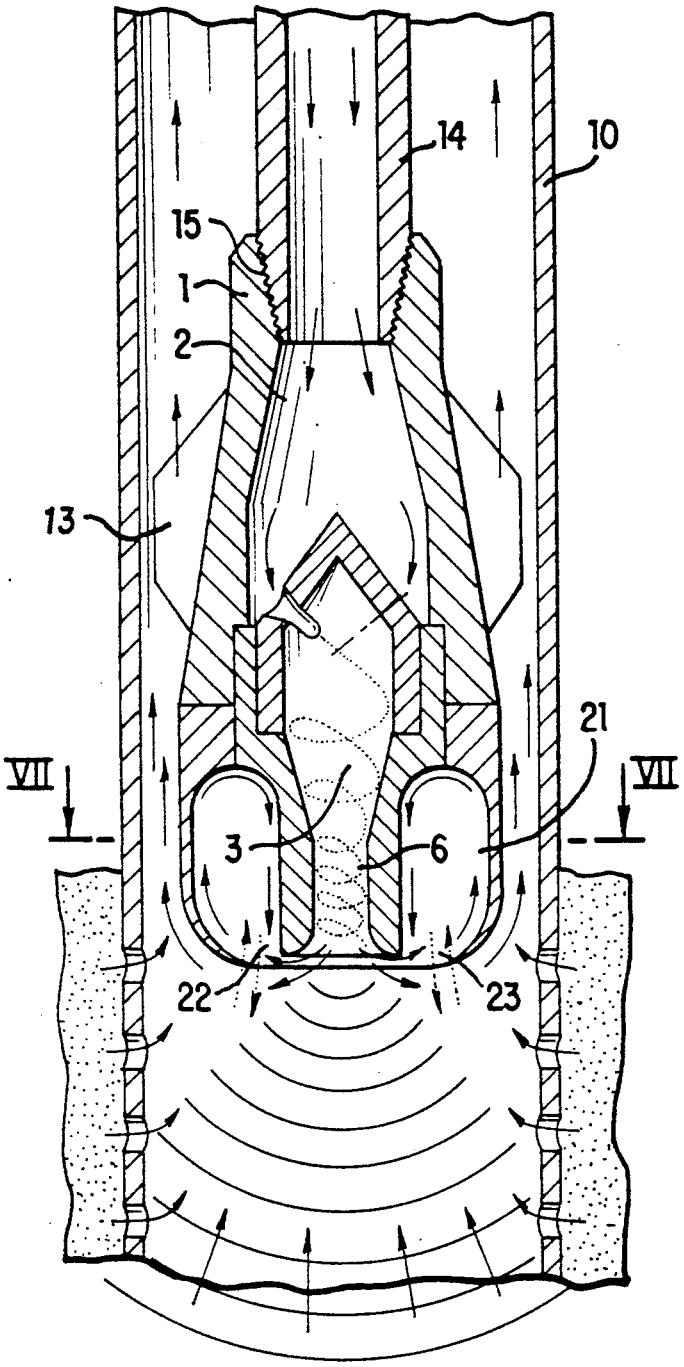
Figure 7:
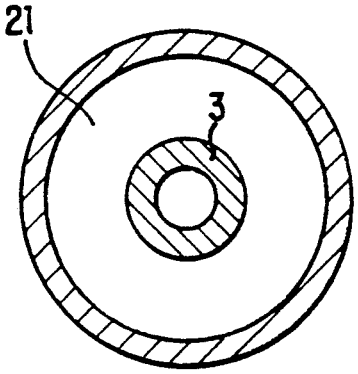
Figure 12:
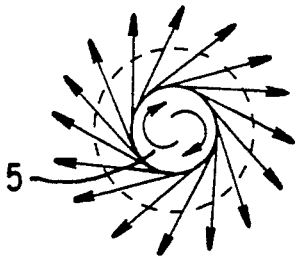
Figure 9:
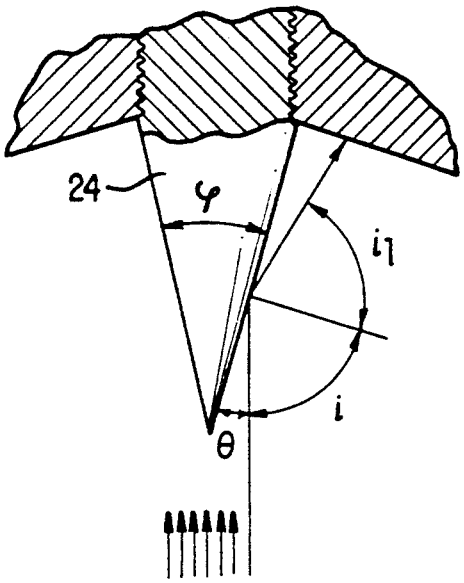
Figure 10:
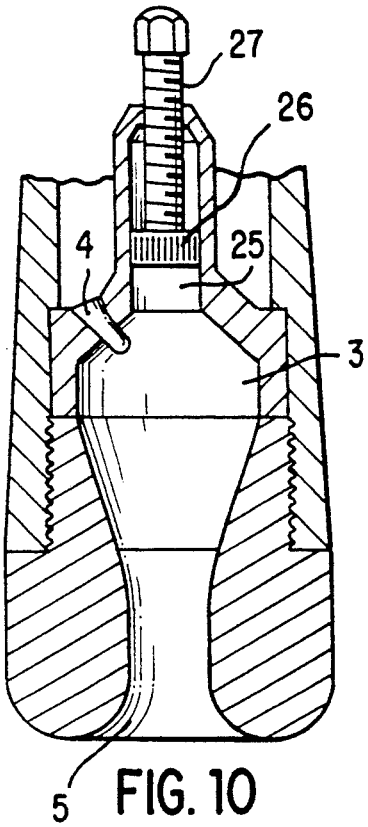
Figure 8:
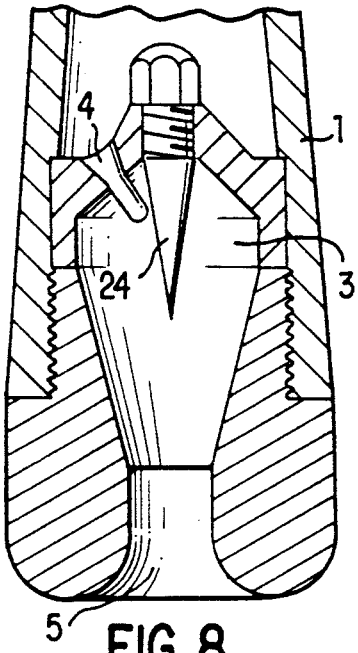
Figure 11:
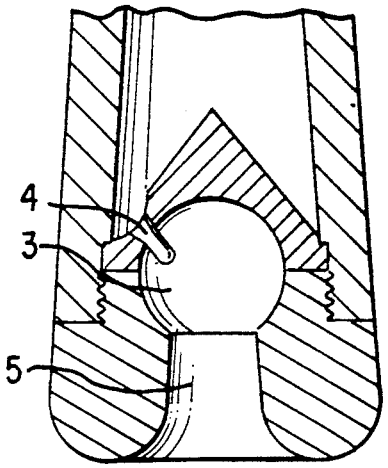

The present invention is explained in greater detail below in a concrete form of construction with the attached drawings. Shown are:

FIG. 1: the complete view of an installation for cleaning the zone near the drill hole;

FIG. 2: a II—II cross-section according to FIG. 1;

FIG. 3: a view in arrow direction A for FIG. 1;

FIG. 4: a view in arrow direction B for FIG. 2;

FIG. 5: the complete view of the installation according to the invention for cleaning the zone near the drill hole, with two additional turbulence chambers;

FIG. 6: the complete view of the installation according to the invention for cleaning the zone near the drill hole, with a toroidal cavity in the wall of the turbulence chamber;

FIG. 7: a VII—VII cross-section for FIG. 6;

FIG. 8: a turbulence chamber according to the invention, with a conical wave guide;

FIG. 9: a conical wave guide according to the invention;

FIG. 10: a turbulence chamber according to the invention, with a resonance chamber;

FIG. 11: a turbulence chamber according to the invention, with a conical interior;

FIG. 12: a sketch of the outflow of a working liquid from the outlet channel of the turbulence chamber.

OPTIMAL FORM OF CONSTRUCTION OF THE INVENTION

The installation according to the invention for cleaning the zone near the drill hole contains a hollow body 1 (FIGS. 1 through 4) with an entry channel 2. A turbulence chamber 3 of a subassembly for generating hydrodynamic waves, with tangentially directed entry channels 4, is arranged inside the body 1. The turbulence chamber 3 has a conically tapering (funnel-shaped) outlet channel 5 for the emergence of a working medium. The frontal surface 6 of the chamber 3 is radially rounded off, and a guide blade 8 is screwed onto the frontal surface with screws 7 in such a way that an annular channel 9 is formed between them communicating with the torus of the drill hole. An annular mixing chamber 11 is formed in the drill hole between the chamber 3 and a pipe-lining column 10, while an annular diffuser 12 is formed between the body 1 and the pipe-lining column 10. In this way the channel 9, the mixing chamber 11 and the diffuser 12 form a radiating pump that creates a partial vacuum during operation and exercises a depression effect on a productive seam. The installation is centered in the drill hole by ribs 13. The installation is connected to the pipe-lining column 14 by tapered threads 15.

To increase the wave effect on a seam, the subassembly for generating hydrodynamic waves can have at least one additional turbulence chamber. FIG. 5 shows a form of construction of the subassembly for generating hydrodynamic waves with two additional turbulence chambers 16, 17 arranged vertically to the axis of the body 1. The turbulence chamber 17 is designed with two outlet channels 18 directed in opposite directions. The tangentially directed outlet channels 19 and 20 of the chambers 16 and 17, respectively, are at an angle to their axes and are directed toward opposite sides. The cross-section of the tangential channels 19 and 20 can be designed in circular or slit shape.

To increase the amplitude of the generated waves, a toroidal resonance chamber 21 with a combined annular entry and outlet channel 22 (FIG. 6) and with a sharp edge 23 can be designed in the wall of the chamber 3 (FIGS. 8, 9).

To reduce any cavitation wear on the turbulence chamber 3 (FIGS. 8, 9), it is equipped with a conical wave guide 24.

To increase the effectiveness of the wave action on a seam, the turbulence chamber 3 (FIG. 10) is equipped with a resonance chamber 25 housing a piston 26 with a rod 27. The rod 27 is connected to the resonance chamber 25 by means of a screw-coupling. The volume of the resonance chamber 25 and consequently the amplitude frequency characteristic of the installation are changed by screwing and unscrewing the rod 27.

To increase the amplitude of the generated waves and the effectiveness of the wave action on a seam, the cavity of the turbulence chamber 3 (FIG. 11) is designed in a spherical shape.

The installation according to the invention for cleaning the zone near the drill hole works as follows. The working medium (liquid, gas or multiphase liquid) is conveyed through the pipes 14 (FIG. 1) into the entry channel 2, from where it flows through the tangentially directed channels 4 into the turbulence chamber 3. In the turbulence chamber 3 the liquid begins to circulate at a high rotating frequency (averaging from $10^3$ to $1.5\times10^3\ s^{-1}$). In the process, hydroacoustic waves are created in the outlet channel 5. Also, the turbulently pulsating current is conveyed out of the outlet channel 5 at a high speed in tangentially diverging directions, as implied in FIGS. 1 and 12, and flows into the annular channel 9. The liquid is directed upward from the annular channel 9 at a high velocity and comes into a torus—a mixing chamber 11—and pulls the injected liquid with it from the zone near the drill hole. In the chamber 11, the velocities of the currents to be mixed are balanced out and the kinetic energy of the working current is partially converted into the potential energy of the blended current. The further conversion of the kinetic energy of the blended current into pressure energy takes place in the cavity of the diffuser 12. In this way the effect of a radiating pump is achieved in the torus, and an additional depression is created in the area of a productive seam. In the process, the productive seam is exposed to a depression effect and a wave effect at the same time. In this process, mechanical activation processes are created in the zone near the drill hole, with signs of various non-linear effects, among which the occurrence of a hydrodynamic and hydroacoustic cavitation is the most important.

When there is a toroidal resonance chamber 21 (FIG. 6), the turbulently pulsating current is conveyed out of outlet channel 5 of the turbulence chamber 3 in tangentially diverging directions and hits the sharp edge 23. At the entry edge 23, hydroacoustic cutting tone waves of low amplitude and self-actuated flectional vibrations of the edge 23 itself (as with flat radiators) are set off. FIG. 6 shows the vibration of the entry edge 23 itself in dotted lines. The radial-tangential current partially comes into the toroidal resonance chamber 21. The flectional vibrations of the entry edge 23 cause a pressure pulsation in the toroidal resonance chamber 21. The annular channel 22 is for the entry and exit of the liquid. In connection with this, the current coming from the toroidal resonance chamber 21 interrupts the entering current with the oscillation frequency of the entry edge 23, and additional hydroacoustic waves are thus generated at the edge 23.

To stimulate intensive hydroacoustic waves, it is necessary for the natural frequencies of all sources of wave generation and all resonators in the generator to be equal or close to each other in amount, i.e.;

$$f_1\ f_2\ f_3,$$

where $f_1$, $f_2$, $f_3$ are the respective natural oscillation frequencies of the turbulence chamber 3, the plate of the entry edge 23, and the toroidal resonance chamber 21.

The hydroacoustic waves and the cavitation effects in the zone near the drill hole lead to a destruction of various deposits on the drill hole wall and to the cleaning of the clogged pore channels of a petroleum-yielding seam. The depression effect triggers the development of the cavitation, accelerates the inflow of petroleum from a seam to the drill hole, and contributes to the removal of cleaning residues from the pore channels. In addition, the wave field results in considerable reduction of the viscosity of seam fluid and petroleum, while the simultaneous depression effect increases their inflow to the drill hole.

INDUSTRIAL APPLICATION

The installation according to the invention can be used for cleaning the drill hole vicinity of a seam in grout drill holes to increase the absorbency of the seam. Without constructional changes it can be used as wave dispersant, wave emulsifier, or wave homogenizer of multiphase liquids, for dispersing the drill flushing liquid and cement grout immediately in the drill hole when the technological operations are carried out.

We claim:

1. An installation for cleaning a zone near a drill hole, comprising:

a hollow body having a cavity and containing therein a subassembly for generating hydrodynamic waves of fluid flow, said subassembly including a turbulence chamber having at least one entry channel for entry of fluid thereinto tangentially arranged in an upper part of the turbulence chamber for connecting said turbulence chamber to said cavity;

said turbulence chamber further including a conically tapering outlet channel for directing said hydrodynamic waves of fluid flow out of said turbulence chamber, and having a rounded-off outer frontal surface; and a guide blade arranged at a lower part of said turbulence chamber so as to form an annular channel between said outer frontal surface and an inner surface of said guide blade, said annular channel developing an annular fluid current from fluid current flowing out of said outlet channel.

2. An installation for cleaning a zone near a drill hole, comprising:

a hollow body having a cavity and containing therein a subassembly for generating hydrodynamic waves of fluid flow, said subassembly including a first turbulence chamber having at least one entry channel for entry of fluid thereinto tangentially arranged in an upper part of the turbulence chamber for connecting said turbulence chamber to said cavity;

said first turbulence chamber further including a conically tapering outlet channel for directing said hydrodynamic waves of fluid flow out of said turbulence chamber, and having a rounded-off outer frontal surface; and at least one additional turbulence chamber arranged in said hollow body above said first turbulence chamber, said additional turbulence chamber being connected to said cavity through at least one tangentially arranged entry channel for entry of fluid thereinto and having two axially arranged conically tapering outlet channels aimed in opposite directions.

3. Installation for cleaning the zone near the drill hole according to either of claims 1 or 2, wherein a toroidal cavity connected with the inside of the first turbulence chamber is designed in the wall of the first turbulence chamber on the section of the arrangement of its outlet channel.

4. Installation for cleaning the zone near the drill hole according to claim 2, characterized in that the tangentially arranged entry channels (19, 20) of the additional turbulence chamber are designed at an angle to its axes and are directed toward opposite sides.

5. Installation for cleaning the zone near the drill hole according to any one of claims 1 or 2, characterized in that the cavity of the first turbulence chamber (3) is designed in spherical shape.

6. Installation for cleaning the zone near the drill hole according to claims 1 or 2, characterized in that the subassembly for generating hydrodynamic waves is equipped with a resonance chamber (25) the cavity of which is connected to the cavity of the turbulence chamber (3) and which houses a piston (26) with a rod (27) with the ability to shift in longitudinal direction.

7. Installation for cleaning the zone near the drill hole according to either of claims 1 or 2, wherein the first turbulence chamber is equipped with a conical wave guide attached in the upper part of the chamber and running inside it in the direction of its longitudinal axis, with the conical taper of the wave guide determined by the relation $$\theta < \alpha \leqq 2\theta', \text{ where}$$

$\alpha$ is the conical taper of the lateral surface of the wave guide;

$\theta'$ is the critical angle of approach of a wave generated in the first turbulence chamber and coming into the wave guide.

* * * * *

UNITED STATES PATENT AND TRADEMARK OFFICE

CERTIFICATE OF CORRECTION

PATENT NO. : 5,311,955

DATED : May 17, 1994

INVENTOR(S) : Rifner W. Ganijew, et. al.

It is certified that error appears in the above-indentified patent and that said Letters Patent is hereby corrected as shown below:

Col. 3, line 32, "$\theta<\alpha\leq 2\theta'$" should be -- $\theta<\varphi\leq 2\theta'$ --; Col. 3, line 34, "$\alpha$" should be -- $\varphi$ --; Col. 3, line 45, "$\alpha$" should be -- $\varphi$ --; Col. 3, line 47, "$\theta<\alpha\leq 2\theta'$" should be -- $\theta<\varphi\leq 2\theta'$ --; Col. 4, line 3, "$\alpha$" should be -- $\varphi$ --; Col. 4, line 4, "$\theta<\alpha\leq 2\theta'$" should be -- $\theta<\varphi\leq 2\theta'$ --; <u>In the Claims:</u> Col. 8, line 15, after "to" insert -- either of --; Col. 8, line 29, "$\theta<\alpha\leq 2\theta'$" should be -- $\theta<\varphi\leq 2\theta'$ --; Col. 8, line 31, "$\alpha$" should be -- $\varphi$ --.

Signed and Sealed this

Twentieth Day of September, 1994

*Attest:*

*Attesting Officer*

BRUCE LEHMAN

*Commissioner of Patents and Trademarks*